US005931722A

United States Patent [19]

Ohmi et al.

[11] Patent Number: 5,931,722

[45] Date of Patent: Aug. 3, 1999

[54] CHEMICAL MECHANICAL POLISHING APPARATUS

[75] Inventors: Tadahiro Ohmi, Miyagi-ken; Man Fujiki, Niigata-ken; Joichi Takada, Osaka-fu, all of Japan

[73] Assignee: Tadahiro OHMI, Miyagi-ken, Japan

[21] Appl. No.: 08/800,922

[22] Filed: Feb. 13, 1997

[30] Foreign Application Priority Data

Feb. 15, 1996 [JP] Japan ..... 8-028326
Aug. 7, 1996 [JP] Japan ..... 8-208658

[51] Int. Cl.[6] ..... B24B 7/04

[52] U.S. Cl. ..... 451/271; 451/287; 451/446

[58] Field of Search ..... 451/41, 60, 63, 451/158, 160, 270, 273, 274, 285, 287, 290, 393, 394

[56] References Cited

U.S. PATENT DOCUMENTS 2,565,590 8/1951 Bullard ..... 451/286
2,948,087 8/1960 Caton .
3,137,977 6/1964 Graves .
3,421,168 1/1969 Bartel ..... 451/271
3,593,465 7/1971 Krippes ..... 451/271
4,128,968 12/1978 Jones ..... 451/41
4,697,388 10/1987 Larsson ..... 451/271
4,916,868 4/1990 Wittstock .
5,105,583 4/1992 Hammond et al. .
5,545,076 8/1996 Yun et al. ..... 451/287
5,702,292 12/1997 Brunelli et al. ..... 451/41

*Primary Examiner*—Timothy V. Eley
*Attorney, Agent, or Firm*—Randall J. Knuth

[57] ABSTRACT

A chemical mechanical polishing apparatus is provided which is capable of polishing an essentially non-streaked mirrored surface in a highly efficient manner, and which is capable of achieving a degree of flatness of +/−0.1 mm or less. The apparatus is provided with a polishing plate holder 43 which adheres to a material to be polished 40 and rotates; a plurality of polishing pads 42 which have a diameter smaller than that of the material to be polished 40 and which are disposed in a symmetrical manner about an axle, a mechanism for causing the plurality of polishing pads 42 to rotate individually, a mechanism for causing the plurality of polishing pads 42 to revolve about the axle and a mechanism for causing the polishing pads 42 to move in a transverse and longitudinal manner with respect to the material to be polished 40; the front surfaces of the polishing pads 42 are caused to rub against the surface of the material to be polished, and a polishing slurry is supplied to the center of the front surfaces of the polishing pads 42. The polishing slurry is supplied in a pressurized manner, and uniformity and flatness are thus improved. The polishing slurry is degassed, and by means of this variations in flatness are reduced. A dummy plate which surrounds the periphery of the material to be polished is provided so as to be in the same plane with the surface to be polished.

10 Claims, 8 Drawing Sheets

CHEMICAL MECHANICAL POLISHING APPARATUS

BACKGROUND OF THE INVENTION

1. Field of the Invention

The present invention relates to a chemical mechanical polishing apparatus which is used to flatten semiconductor substrate surfaces and the like during the processing thereof 2. Description of Related Art Recently, the increasing miniaturization and difference in levels of semiconductor devices has been striking. In order to form a minute pattern, the wavelength of the stepper light source used in the photolithographic process has been reduced in order to make smaller the horizontal resolution R shown in Formula (1), and the NA value (numerical aperture) has been made larger.

As a result, the depth of focus (DOF) during exposure becomes shallower, as shown in Formula (2), and the focus margin becomes smaller. Furthermore, when the unevenness on the surface becomes severe, the light reflected from the surface is reflected at a slanted angle during exposure, so that the exposure pattern becomes disordered. As a result, it is necessary to completely flatten such surfaces in the manufacturing process of semiconductor devices having minute patterns.

$$R=K_1 \cdot L/NA \quad (1)$$

$$DOF=K_2 \cdot L/(NA)^2 \quad (2)$$

Here, L indicates the wavelength of the light source, while NA indicates the numerical aperture of the optical system.

A chemical mechanical polishing method (CMP: chemical mechanical polishing) has been developed as flattening technology for semiconductor substrate surfaces in the manufacturing processes of semiconductor devices which are minute and have a large difference in levels. These chemical mechanical polishing methods can be employed, for example, in the flattening of poly Si embedded in trenches, interlayer insulating films in the case of multilevel wiring or the like, and metallic wiring in the case of aluminum alloy thin films or the like.

A schematic view of a conventional chemical mechanical polishing apparatus is shown in FIG. 8.

A Si wafer 60 comprising the substrate to be polished, having formed thereon interlaying insulating films, has the surface thereof affixed to a rotatable support stand 61 by means of suction or the like. Commonly, a cushioning material such as a rear surface pad or the like is attached between the support stand 61 and the wafer 60 which is to be polished; this rear surface pad applies a uniform pressure to wafer 60.

While rotating support stand 61, the surface of wafer 60 is pushed against stage 63, to the surface of which is affixed a polishing pad 64. Stage 63 is also made to rotate. The pressure applied is commonly within a range of 0.3–0.6 $kg/cm^2$.

During polishing, a polishing slurry in which inorganic microgranules, such as silica or the like are dispersed, is dripped onto the surface of the polishing pad 64. A plurality of narrow groves are provided in the circumferential direction in the surface of stage 63, so that the polishing slurry might effectively flow into the interface between the surface of wafer 60 and the surface of polishing pad 64. The microgranules in the slurry promote polishing by means of mechanical action with respect to the wafer surface. In this method, wafer 60 rotates and revolves and polishing pad 64 also rotates, and the diameter of polishing pad 64 is larger than that of wafer 60.

However, the conventional chemical mechanical polishing apparatus described above proved to have the following problems.

(1) Presently, an even greater degree of flatness (+/−0.1 mm or less) is required; however, it is impossible to fulfill such requirements with the conventional apparatus described above.

(2) The uniformity within the surface is poor (at best, on the level of +/−10%).

(3) An extremely large amount of polishing slurry is employed.

(4) The polishing slurry does not penetrate uniformly to the interface, and bonding is likely to occur.

(5) When wafers having a large diameter are polished, it is necessary to employ large polishing plates, and as a result, the overall size of the apparatus becomes extremely large.

In order to flatten a surface by polishing, the polishing slurry must be uniformly supplied to the interface between the surface which is to be polished and the surface of the polishing pad, and the relative motion between the surface of the material to polished and the surface of the polishing pad must be such that the movement of the microgranules in the polishing slurry is uniform in all directions in the vicinity of all surfaces. This has not been realized in the case of apparatuses in which the surface of the polishing pad is larger than the surface of the material to be polished.

The views stated above, including the problems present in the conventional methods, are completely novel views arrived at by the present inventors.

On the other hand, a polishing apparatus has been disclosed (Japanese Patent Application, First Publication No. Hei 1-170556) in which an epicyclic gear mechanism is provided on the polishing head, the polishing pads can be made to revolve and rotate by means of the epicyclic gear, and the front surface of the polishing pads is caused to rub against the surface of the material to be polished; furthermore, a transverse slide mechanism and a longitudinal slide mechanism are provided so that the polishing head may be caused to move in a zigzag fashion relative to the material to be polished.

This polishing apparatus is capable of minutely and symmetrically finishing a comparatively large sized flat surface to a non-streaked mirrored surface, and is employed in the polishing of stainless steel plates.

However, it is unclear whether the degree of flatness of +/−0.1 mm described above can be achieved using this apparatus. In the case of semiconductor wafers, the surface does not comprise a uniform material; interlayer insulating films such as BPSG or the like, Al alloy, polysilicon, and the like may be present. When the present inventors assayed this experimentally, when semiconductor wafers were polished using this apparatus, the degree of flatness described above was not achieved, and furthermore, there were problems in that in comparison with the central portion, the outer circumferential portion was either insufficiently polished or excessively polished.

SUMMARY OF THE INVENTION

The present invention solves the problems described above; and has as an object thereof, to provide a chemical mechanical polishing apparatus and chemical mechanical polishing method which are capable of polishing to an essentially non-streaked mirrored surface in a highly efficient manner, and which are furthermore capable of achieving a degree of flatness of +/−0.1 mm.

In order to solve the problems above, the chemical mechanical polishing apparatus of the present invention is provided with: a polishing plate holder which adheres to the material to be polished and rotates, a plurality of polishing pads having a smaller diameter than the diameter of the material to be polished, which are disposed in a symmetrical manner about an axle, a mechanism for causing each of the plurality of polishing pads to rotate, a mechanism for causing the plurality of polishing pads to revolve about the axle, and a mechanism for causing the polishing pads to move transversely and longitudinally relative to the material to be polished;

the front surface of the polishing pads is caused to rub against the surface of the material to be polished, and a polishing slurry is supplied to the center of the front surface of the polishing pads.

Furthermore, in the chemical mechanical polishing method of the present invention, a plurality of polishing pads having smaller diameters than the diameter of a material to be polished, which are disposed in a symmetrical manner about an axle, are caused to rotate;

the plurality of polishing pads are caused to revolve about the axle;

the plurality of pads are caused to move in a transverse and longitudinal manner relative to the material to be polished; and the front surfaces of the polishing pads are caused to rub against the surface of the material to be polished, and a polishing slurry is supplied to the center of the front surface of the polishing pads, and thereby, polishing is conducted.

In the present invention, the plurality of polishing pads are constantly caused to rotate, and the plurality of polishing pads are caused to revolve around the axis of symmetry thereof, and the structure is such that the material to be polished itself is also caused to rotate. Furthermore, since mechanisms are provided for moving the polishing pads transversely and longitudinally relative to the material to be polished, the polishing pads and the material to be polished may be rubbed against one another in a non-stop manner. Moreover, the polishing slurry is supplied to the center of the front surface of the polishing pads. The transverse motion mechanism and longitudinal motion mechanism described above can be operated independently of one another.

Accordingly, the polishing slurry is supplied uniformly to the interface between the surface of the material to be polished and the surface of the polishing pads, and relative motion of the surface of the material to be polished and the surface of the polishing pads is such that the motion of the microgranules in the polishing slurry is uniform in all directions in the vicinity of all surfaces. As a result, it is possible to attain the desired degree of flatness.

When the apparatus in accordance with the present invention is employed, the rotational speed of the polishing pads should be within a range of 1,000–1,500 rpm, and the speed of revolution is optimally within a range of 60–100 rpm. Furthermore, the rotational speed of the material to be polished is optimally within a range of 50–300 rpm.

Furthermore, the relative transverse and longitudinal speeds between the polishing pads and the material to be polished are optimally within a range of 1–3 m per minute.

Furthermore, as shown in FIG. 1, a dummy plate 41 which encloses the periphery of a material to be polished 40 (a semiconductor wafer having a large difference in level) is provided so as to be essentially in the same plane with the surface to be polished of the material to be polished 40, 50 that even if a portion of the polishing pad 42 extends to the outside of the material to be polished 40, this portion will be on top of the dummy plate 41, so that the polishing pad 42 will not incline, and the outer periphery of the material to be polished 40 will not be excessively polished. The surface of the material to be polished 40 and the surface of the dummy plate 41 should be essentially in the same plane. When the surface of the dummy plate is slightly lower than the surface of the material to be polished (when there is a slight difference in level) the corners of the surface to be polished are polished; and since a bevelled state (that is to say, a state in which the sharp corners are rounded) is achieved, it is possible to prevent chipping.

(Description of the References)

1 stage,
6 polishing head,
7 transverse motion mechanism,
8 longitudinal motion mechanism,
21 support frame,
24 sun gear,
25 epicyclic gear,
26 hollow axle,
40 material to be polished (semiconductor wafer),
41 dummy plate,
42 polishing pad,
43 holder (stage),
44 groove,
45 polishing slurry exhaust port,
46 gap,
47 ejector pin,
49 nozzle (for wafer washing),
50 ultrasonic element,
51 washing water,
60 material to be polished,
61 support body,

63 stage,
64 polishing pad,
65 polishing slurry,
81 hemispherical platform,
83 polishing slurry supply tube,
84 air gap,
701 chemical mechanical polishing apparatus,
702 vacuum module,
703 vacuum pump,
704 liquid supply pump,
705 slurry tank.

DESCRIPTION OF THE PREFERRED EMBODIMENTS

An embodiment of the present invention will be explained based on FIG. 1.

It is preferable that a gap 46 of 1–3 mm be provided between the dummy plate 41 and the periphery of the material to be polished 40. After use, the polishing slurry travels from the polishing surface via this gap 46 to a polishing slurry exhaust port, and flows out to the exterior. If the dimensions of this gap 46 are less than 1 mm, outflow will not be possible. Furthermore, when the gap is in excess of 3 mm, a difference in level is formed, and the edge of the wafer is excessively polished, so that dimensions of 3 mm or less are preferable.

Figure 2:
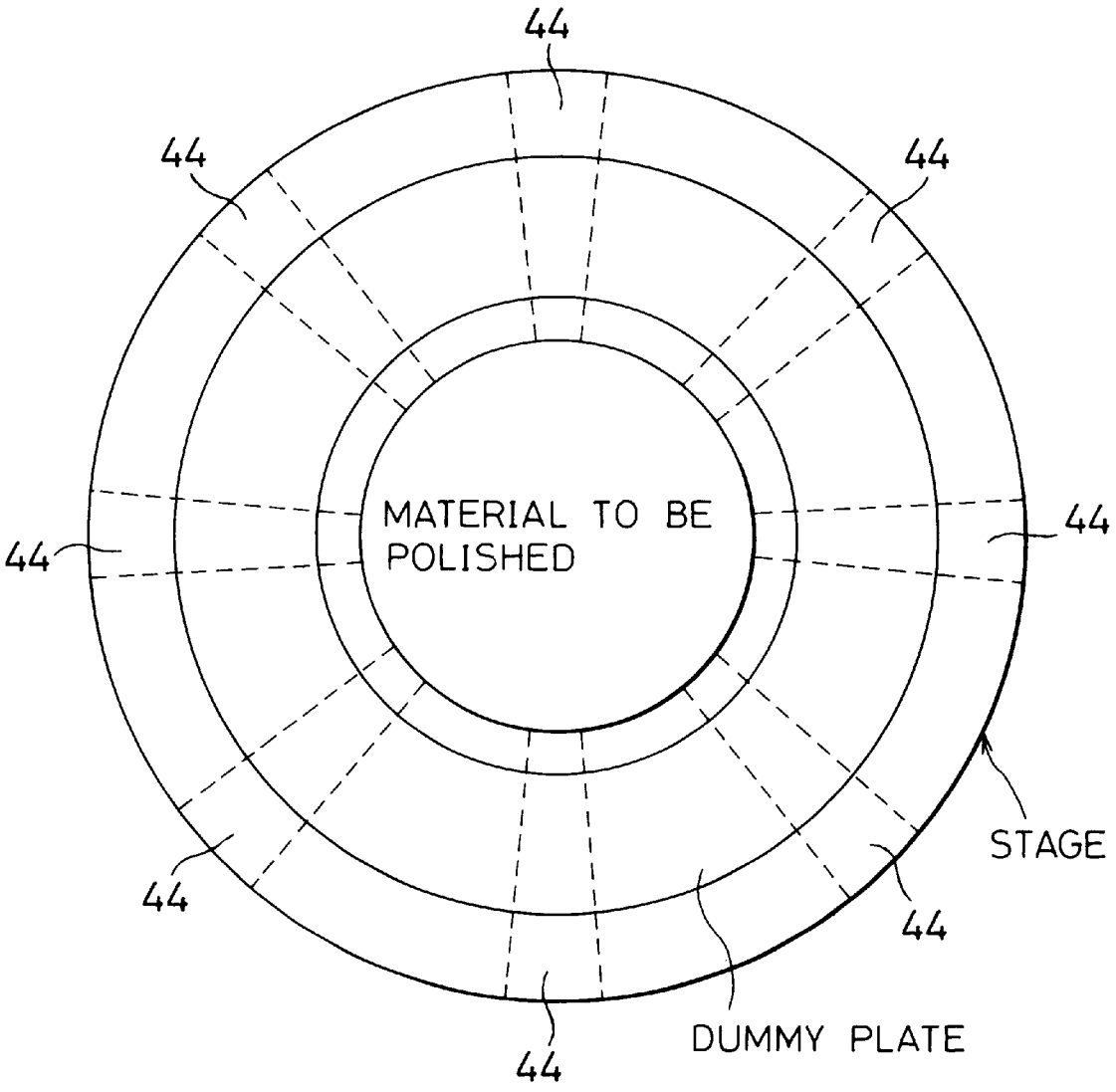
FIG. 2 is a planar schematic diagram showing the holder of the chemical mechanical polishing apparatus in accordance with an embodiment of the present invention.

Furthermore, a plurality of grooves 44 are provided in a radial manner in the rear surface of dummy plate 41, and these grooves 44 serve as a flow path for the polishing slurry and make possible a more reliable outflow of the polishing slurry after use. Alternatively, a plurality of radial grooves may be provided in the surface of the stage 43 which is in contact with the lower surface of the dummy plate 41, and these may form the flow path of the polishing slurry. This is shown in FIG. 2.

With respect to the material of dummy plate 41, this should preferably be a material which is harder than the material of the material to be polished 40. By means of this, it is possible to prevent a reduction in the thickness of the dummy plate 41. When the material to be polished 40 comprises a semiconductor wafer, alumina or the like is preferably employed.

Furthermore, variations of approximately 50 mm exist in the thickness of the semiconductor wafers, so that it is preferable that the thickness of the dummy plate employed should approximately 50 mm thinner than the average thickness of the semiconductor wafers.

Figure 1:
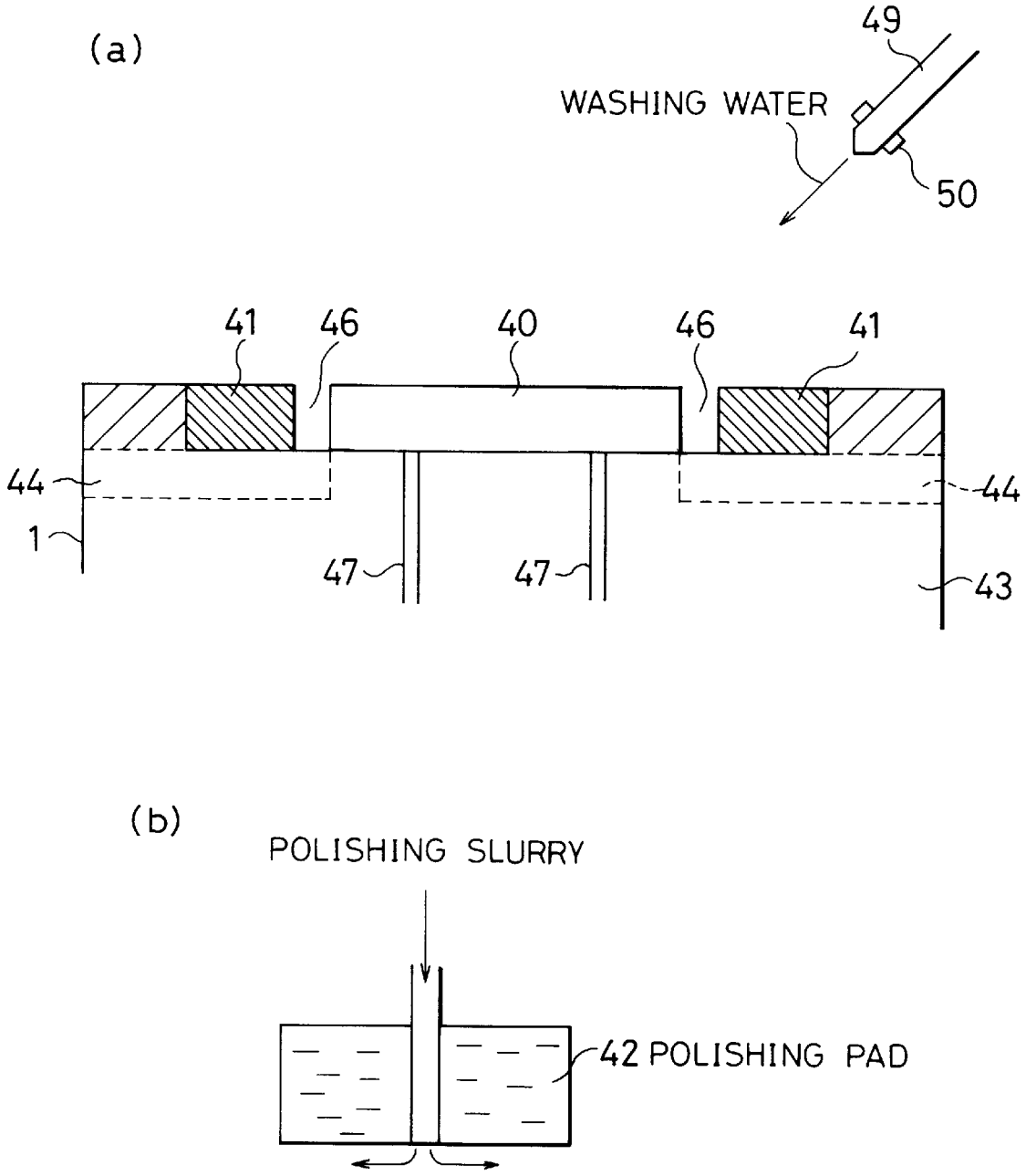
FIG. 1 is a side cross-sectional schematic diagram showing the chemical mechanical polishing apparatus in accordance with an embodiment of the present invention in the vicinity of the holder portion.
Figure 8:
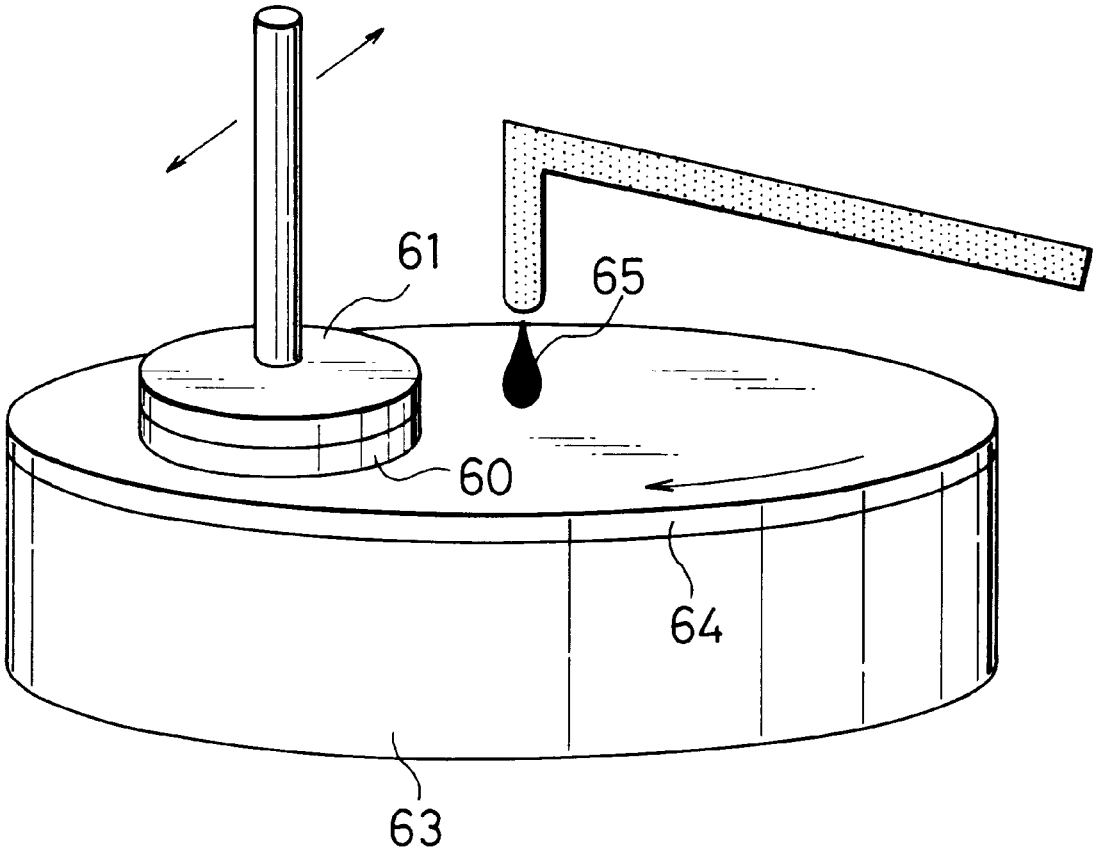
FIG. 8 PRIOR ART
FIG. 8 is an angled view showing a conventional example.

Furthermore, as shown in FIG. 1(*b*), the polishing slurry is supplied to the center of the front surface of the polishing pad 42; this is particularly important from the point of view of reducing the amount of polishing slurry employed, and preventing bonding. That is to say, the present inventors have discovered that in the case in which, as shown in FIG. 8 which depicts conventional technology, polishing slurry 65 is supplied from the exterior of the contact surface between the polishing pad 64 and the wafer 60, essentially no polishing slurry 65 is supplied to the surfaces in contact. For this reason, in the conventional apparatus, it was necessary to supply an amount of polishing slurry than was greater than that which was actually required. Accordingly, it is preferable that the structure be such that the polishing slurry is supplied to the front surface of the polishing pad. Such a structure could not be adopted in the apparatus having the structure shown in FIG. 3; however, the use of such a structure has become possible for the first time by employing, as polishing pads, pads which have a smaller diameter than the diameter of the material to be polished, as in the apparatus of the present invention.

In order to press the polishing pad against the material to be polished, the use of an air cylinder is preferable. Furthermore, it is preferable that changes in the pressure of the air cylinder be detected, the pressure be controlled so as to maintain a constant value, and that by means of this the pressure at each air cylinder be maintained at a constant level.

Figure 3:
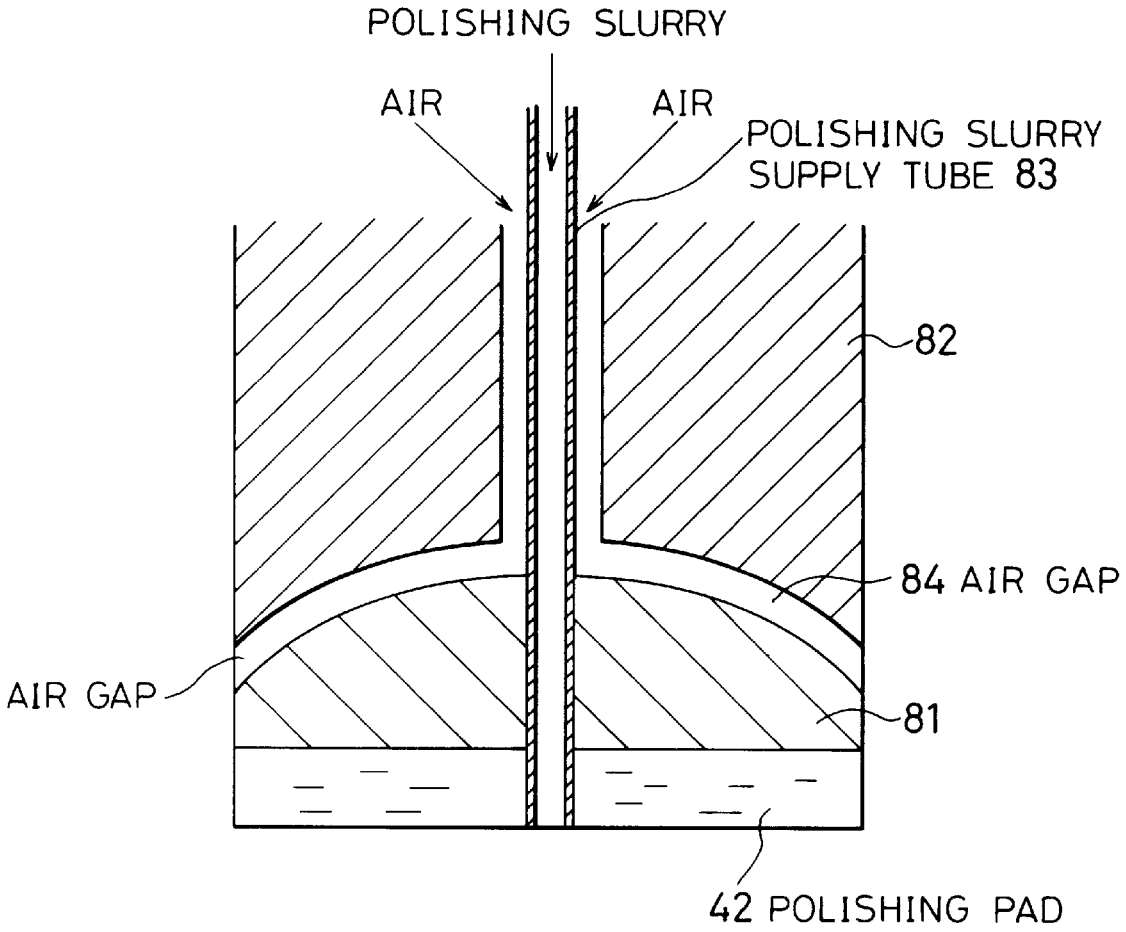
FIG. 3 is a side cross-sectional schematic diagram showing the polishing pad of the chemical mechanical polishing apparatus in accordance with an embodiment of the present invention.

An air bearing method such as that shown in FIG. 3 is extremely effective in adsorbing to the slight irregularities in the surface (approximately 10 mm in a Si wafer). That is to say, polishing pad 42 is provided at the lead end of a hemispherical platform 81. This platform 81 is suspended from a flexible polishing slurry supply tube 83 which penetrates the interior of the platform. It is possible to control the pressure of the polishing pad 42 against the material to be polished by means of the air pressure supplied to an air gap 84. The polishing thickness is at the most 2 to 3 mm, so that the pressure may be set to a level of approximately 100 grams/cm$^2$ or less. At this level, sufficiently rapid polishing can be conducted.

The type of polishing slurry, polishing pressure, frequency of rotation or revolution of the polishing pads, relative speed of longitudinal and transverse motion, and rotational frequency of the material to be polished are appropriately selected in accordance with the type of film to be polished and the amount of polishing to be done. However, the rotational frequency of the polishing pads should be set so as to be sufficiently greater than the frequency of revolution, and polishing should be conducted by means of the rotation of the polishing pads.

Furthermore, in FIG. 1, reference 49 indicates a nozzle for washing the surface of the wafer 40 after the completion of polishing; ultra pure water, ultra pure water with O added, or hydrofluoric acid or hydrogen peroxide diluted with ionized water or the like, to which ultrasound within a range of 0.5–5 MHz is applied with an ultrasonic element 50, is supplied from nozzle 49.

Figure 4:
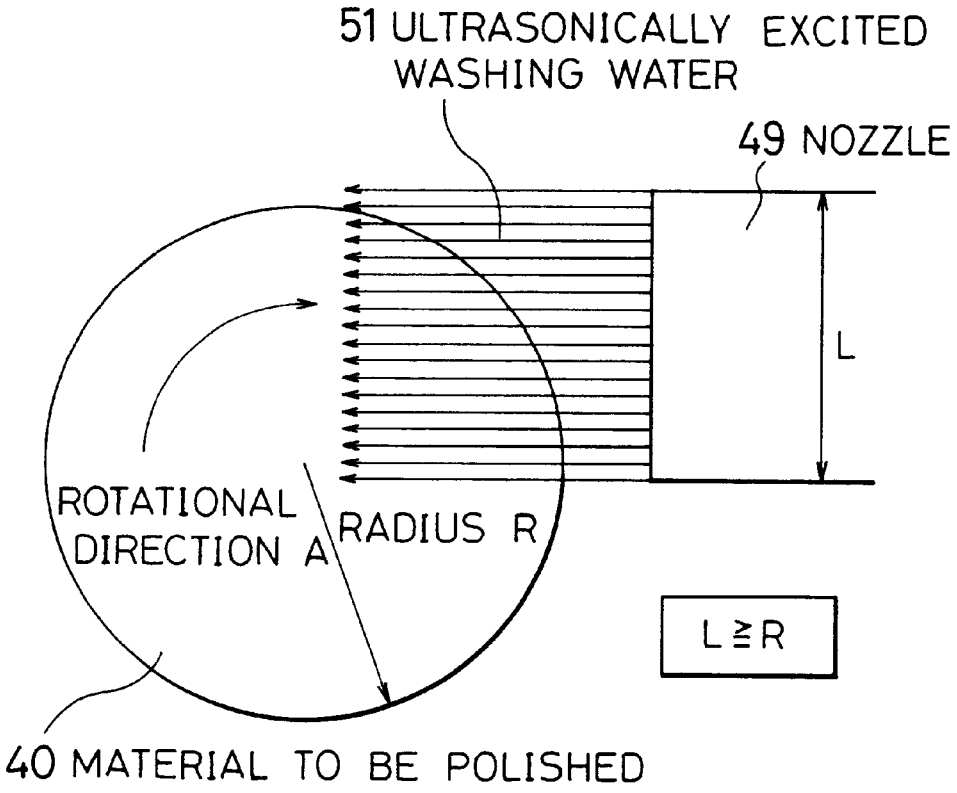
FIG. 4 is a planar and side view showing the arrangement of the washing mechanism of the chemical mechanical polishing apparatus in accordance with an embodiment of the present invention.
Figure 4:
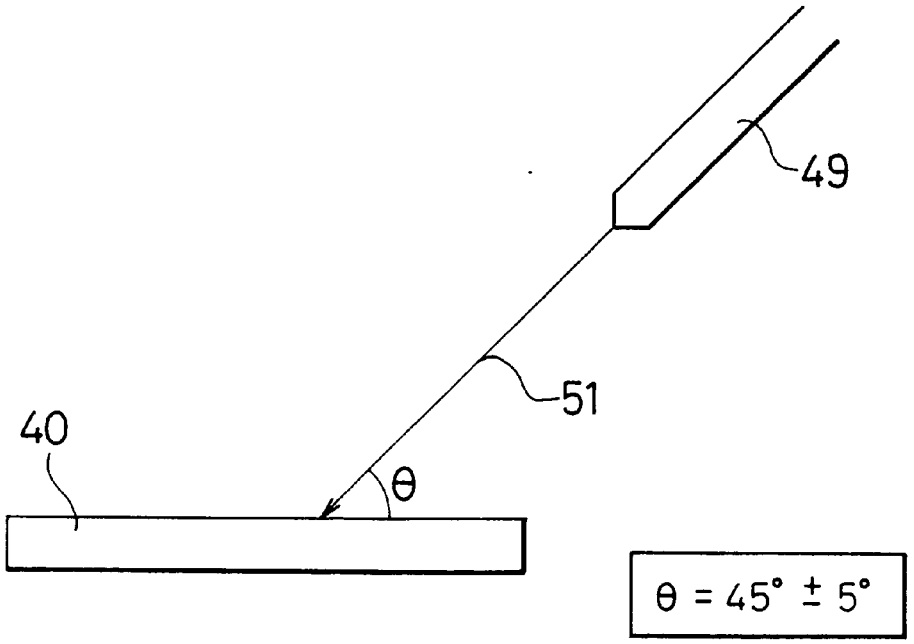

As shown in FIG. 4, the nozzle is provided with a linear supply port which is longer than the radius R of the material to be polished 40, and supply is conducted at an angle of approximately 45°(40–500) with respect to the surface of the material to be polished. Washing water (washing water which has been subjected to ultrasonic excitation) 51 is applied against the rotational direction of the surface of the rotating material to be polished 40, at an angle of approximately 45°, and is applied (FIG. 4) over a distance L which is at least greater than the radius R; the shape of the blowout nozzle is not limited to a linear shape. The shape may be round. Irrespective of the shape, the size of the blowout port is set so as to be larger than the wavelength of the ultrasound within the washing water, and the structure is such that the megasonic ultrasound is capable of efficiently passing through the blowout port and reaching the surface of the material to be polished. A distance of a few centimeters is appropriate between the blowout nozzle and the surface of the material to be polished. In the case of a round nozzle, since there are localized regions which do not come into contact with the washing water, if a plurality of nozzles are provided, and these are caused to move back and forth in a radial direction, the washing effectiveness may be increased, and high speed washing may be conducted.

Furthermore, after megasonic ultrasound washing, the wafer 40 is pushed upward by means of a plurality of ejector pins which are provided at positions of axial symmetry, and the wafer 40 is removed from the holder (stage) 43. The washing of the stage 43 is conducted by applying megasonically excited washing water from nozzle 49 while rotating holder (stage) 43.

Since the pressure of the polishing pad is approximately 100 grams/cm$^2$ or less, the adhesion of the material to be polished to the stage can be accomplished solely by the surface tension of the ultrapure water.

(Supply Pressure)

In the present invention, the supply of the polishing slurry may be accomplished by means of a dripping method using the weight of the slurry; however, pressurized supply by means of a pump is particularly preferable. The preferable supply pressure is dependent on the amount of polishing slurry supplied, the pressure of the polishing pad, the material of the polishing pad, and the frequency of rotation of the polishing pad; however, a pressure within a range of 10–100 g/cm$^2$ is preferable. Within this range, the polishing efficiency and uniformity of polishing are dearly superior to those at pressures outside this range. In particular, the normal flow rate of the polishing slurry is within a range of 100–300 ml/min; however, in the present invention, if the supply pressure is within the range described above, sufficient polishing effectiveness can be obtained at reduced amounts of polishing slurry supply within a range of 50–100 ml/min. However, at amounts greater than 100 g/cm$^2$, a fluid film may be created between the polishing pad and the material to be polished, and when such a fluid film is created between the polishing pad and the material to be polished, the polishing pad is likely to slip, and this may adversely effect the polishing effectiveness. Accordingly, the supply pressure should be within a range of 10–100 g/cm$^2$. A range of 40–90 g/cm$^2$ is further preferable, and a range of 50–80 g/cm$^2$ is even more preferable.

(Degassing)

In accordance with the invention, a degree of flatness of less than +/−0.1 microns can be achieved. However, it has been learned that when the polishing of a large amount of material to be polished is conducted, undesirable variations in the degree of flatness are produced. Upon studying the causes of this phenomenon, the present inventors have determined that this undesirable variation is produced as a result of the following causes. That is to say, reaction products of the chemical etching are emitted as gasses, and gas bubbles are produced. The presence of these gas bubbles causes the variation.

In the present invention, the polishing slurry is degassed. When the polishing pad and the material to be polished move relative to one another, and air present around the polishing pad is incorporated in the interface between the pad and the material to be polished, when a degassed polishing slurry is employed, the air which is incorporated becomes dissolved in the degassed slurry. That is to say, the generation of gas bubbles is prevented, and the interface between the pad and the material to be polished is filled with polishing slurry, so that the variations are minimized. Since the reason for degassing is as given above, the degassed gases are not limited to air.

Furthermore, the amount of dissolved gases present after degassing may be appropriately determined in accordance with permissible ranges of variation. That is to say, as the amount of dissolved gasses decreases, the amount of air which can be dissolved increases, and the generation of gas bubbles becomes less likely, so that the variation becomes smaller. However, above a certain level of degassing, the effects become saturated, and as further degassing is uneconomical, the appropriate amount of degassing can be determined experimentally in accordance with the type of polishing slurry and in accordance with the permissible amount of variation. It is preferable that the amount of gases dissolved in the polishing slurry be reduced to a level of parts per billion (ppb).

Figure 7:
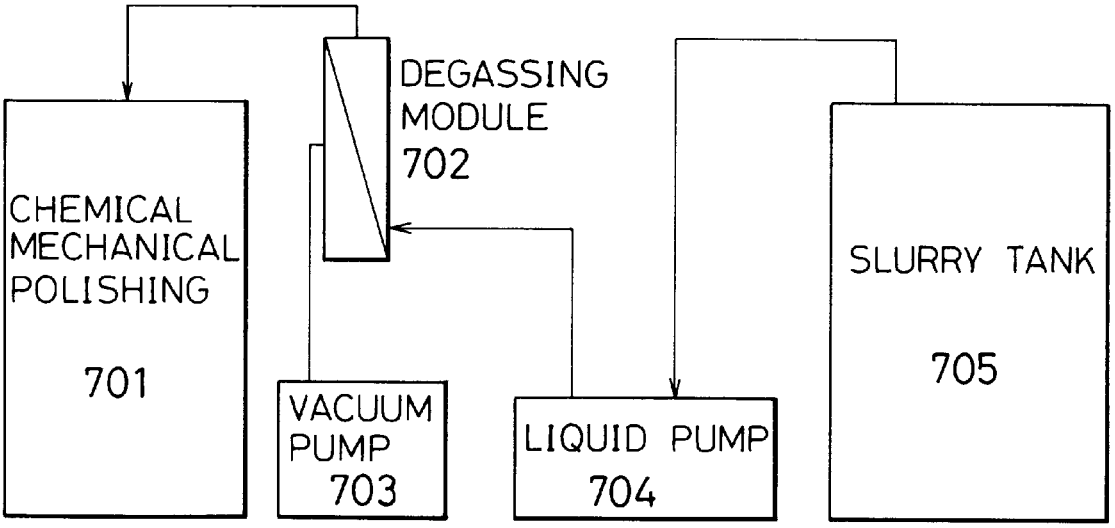
FIG. 7 is a system diagram showing an embodiment mode of the present invention.

FIG. 7 is a system diagram showing a chemical mechanical polishing apparatus which is provided with a mechanism (a fluid pump) 704 for pressurizing and supplying polishing slurry, and a mechanism (degassing module) 702 for removing gas from the polishing slurry.

Reference 705 indicates a slurry tank which stores polishing slurry; it is commonly open to the atmosphere. However, a closed system is preferable in which the slurry does not come into contact with the atmosphere from the point of view of reducing the entry of gas into the polishing slurry during storage. The polishing slurry within slurry tank 705 is sent under pressure to degassing module 702 by means of a liquid pump. Solid-liquid separation is conducted in degassing module 702. Hollow yarn, for example, may be provided in the interior thereof. A vacuum pump is connected to the gas side of the degassing module 702, and because the gas side is subjected to evacuation, the amount of gas dissolved in the polishing slurry may be reduced to a level of ppb or ppt.

Figure 5:
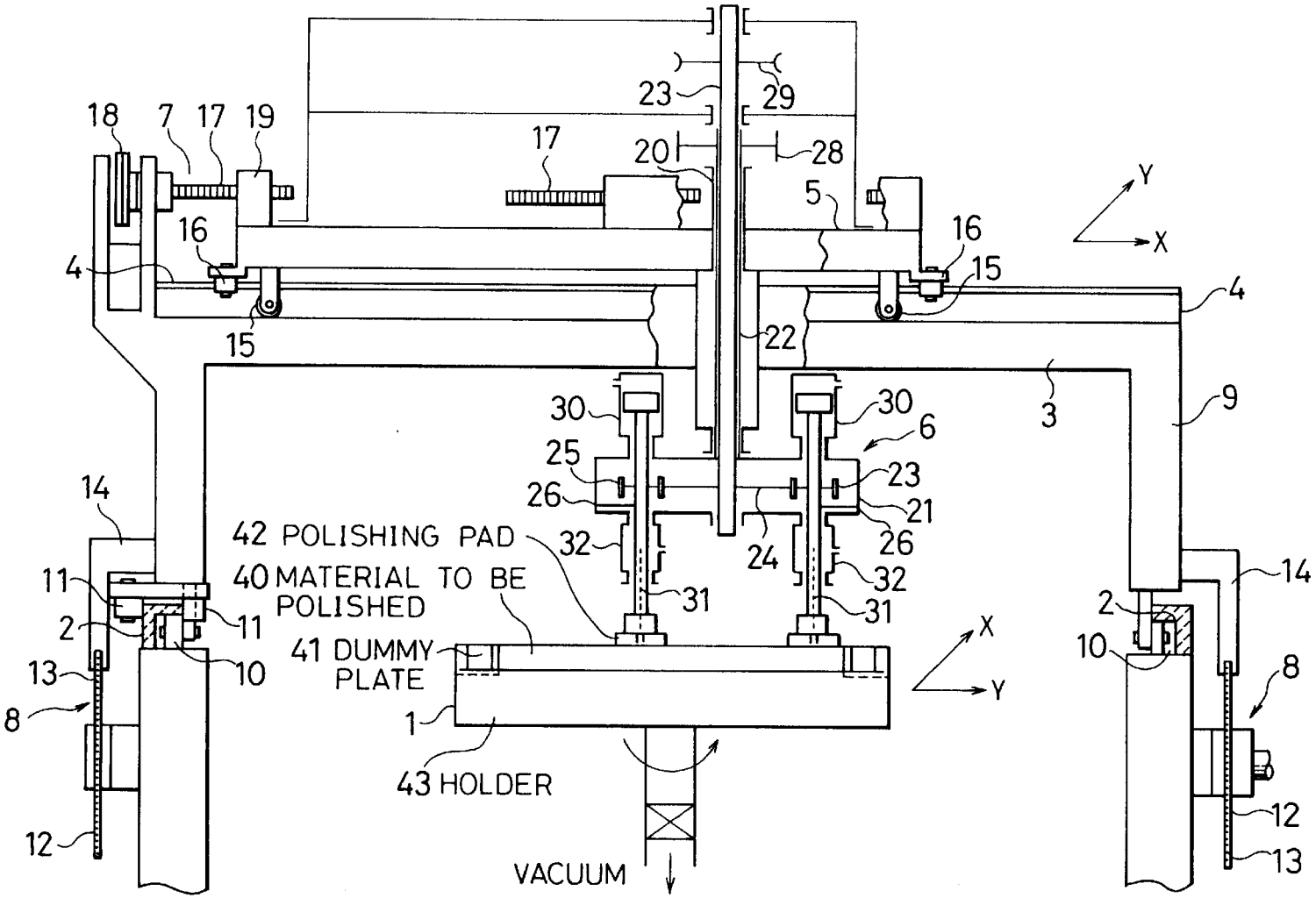
FIG. 5 is a side view showing the entirety of the chemical mechanical polishing apparatus in accordance with an embodiment of the present invention.

The degassed polishing slurry is pressurized and supplied to the chemical mechanical polishing apparatus shown in FIG. 5.

Hereinbelow, embodiments of the polishing apparatus of the present invention will be explained in detail using the Figures.

FIG. 5 is a partially cross-sectional front view of the polishing apparatus of an embodiment of the present invention.

Holder 43 can be rotated. Furthermore, the structure is such that this may be moved in a transverse direction (the direction indicated by X: right and left in the figure) and in the longitudinal direction (the direction marked by Y: perpendicular to the plane of the diagram) independently of polishing pads 42. Polishing holder 43 adheres to the material to be polished via a vacuum. Furthermore, the mechanism for rotating holder 43, and the mechanisms for moving the holder in the longitudinal or transverse directions, are not depicted; however, mechanisms which are commonly employed may be appropriately used.

Figure 6:
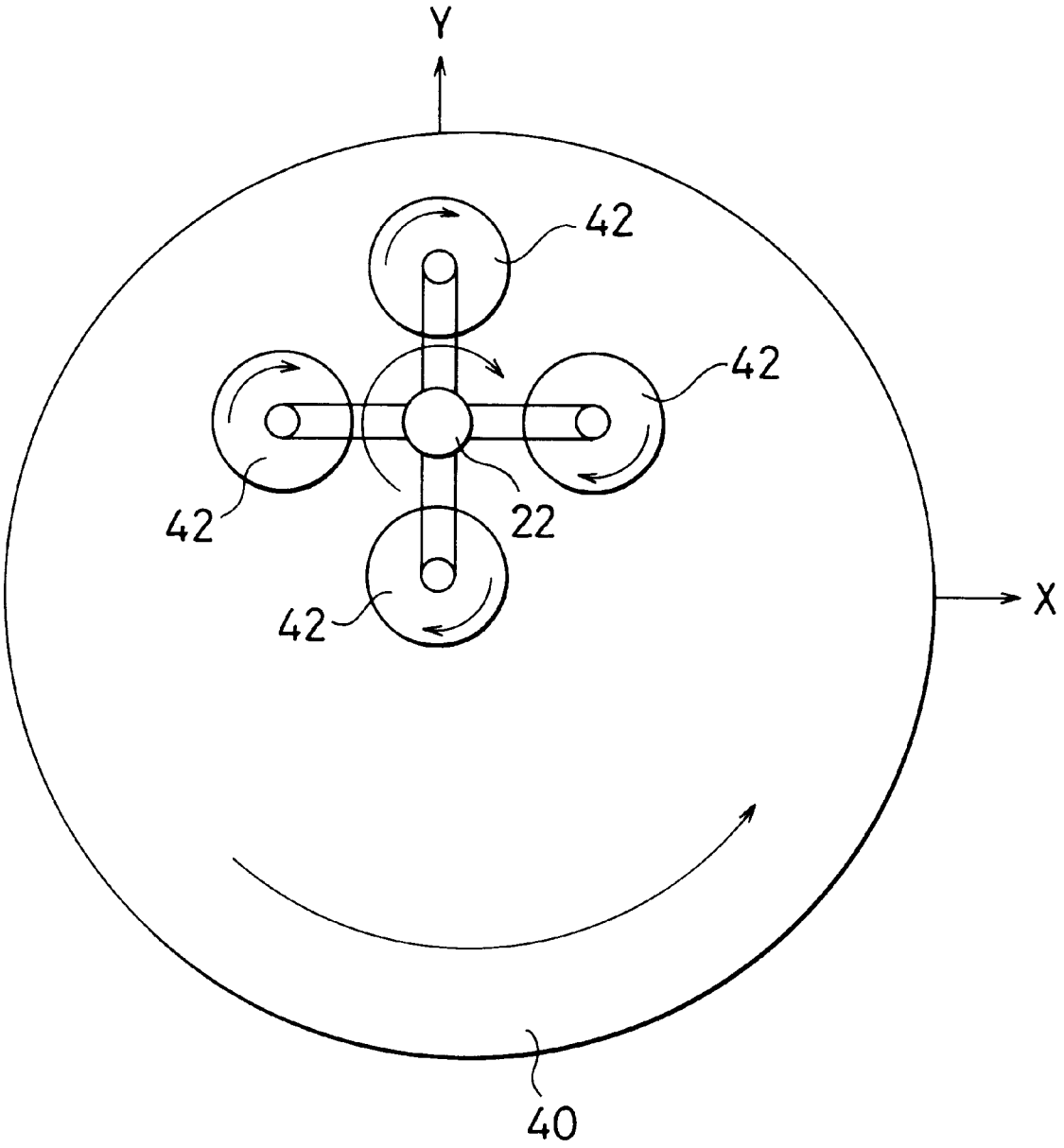
FIG. 6 is a planar view showing the motion of a polishing pad of the chemical mechanical polishing apparatus in accordance with an embodiment of the present invention.

In the present example, four polishing pads 42 are employed. As shown in FIG. 6, the four polishing pads are disposed symmetrically about a hollow axle 22. As shown in FIG. 5, the polishing pads hang from this hollow axle 22.

Next, the structure involved in the rotation, revolution, longitudinal movement, and transverse movement of the polishing pads 42 will be concretely discussed.

This structure comprises a framework 3, which is provided completely independently of the stage 43 and is capable of sliding along rails 2,2 in a forward and back direction, a support frame 5 which is capable of sliding along rails 4,4 which are provided in a left and right direction above framework 3, a plurality of polishing heads 6,6, which are provided so as to hang from support frame 5 and are freely rotatable, a transverse motion mechanism 7 for causing the framework 5 to move in a left and right direction, and a longitudinal motion mechanism 8 for causing the framework 3 to move in a forward and back direction.

Within framework 3, rollers 10, 10 for preventing vertical motion are provided in such a manner as to maintain an appropriate gap in the forward and backward direction with respect to the legs 9,9 on both sides, and rollers 11, 11 for preventing left and right motion are provided so as to sandwich rails 2, and it is thus possible to move framework 3 in a forward and back direction in a smooth manner while rollers 10,10 and 11,11 are in contact with rails 2,2; additionally, as longitudinal motion mechanism 8, a chain 13 which travels in the forward and back direction is provided in a state in which it is suspended from sprockets 12, 12 at the outside of both sides of stage 1, and these are engaged with framework 3 at passive arms 14; furthermore, in support frame 5, rollers 15,15 for preventing vertical motion are provided so as to maintain an appropriate gap in the forward and rearward direction from the end portions on the left and right sides, and rollers 16, 16 for preventing forward and back motion are provided in such a state that they sandwich rails 4, and support frame 2 is thus capable of being moved smoothly in a left and right direction while rollers 15,15 and 16, 16 are in contact with rails 4; additionally, as transverse motion mechanism 7, a screw travel type is selected in which a screw rod 17, the axis of which is in the left and right direction, is provided on framework 3 so as to be rotatable by means of a passive wheel 18, and this engages with the female screw 19 of support frame 5.

With respect to polishing head 6, bearings 20, 20 are provided in support frame 5 in the perpendicular axial direction and these penetrate and support the central axle 22 and the sun gear 24 of the epicyclic gear support frame 21 in a coaxial manner, and sun gear 24 is affixed to axle 23 within support frame 21, a plurality, approximately two to four, of epicyclic gears 25, 25 are engaged with this sun gear 24, the axles 26 thereof depend therefrom, and cylindrical polishing pads 42 are affixed to the lower ends thereof; a gear type passive pulley 28 is provided at the upper end of the hollow axle of the support frame 21, and the support frame 21 can be rotated at a comparatively low speed by means of a motor via a speed reducer and toothed belt (not depicted in the Figure) or the like; furthermore, at the upper end approach of sun gear axle 23, V pulleys 26 are affixed, and by means of V belts, and motors (not depicted in the Figure), this is rotated at a desired speed, which may be a comparatively high or low speed, or may be maintained in a stopped state; in short, by means of the epicyclic gear mechanism, polishing pads 42 may be caused to rotate and revolve.

In order to press each polishing pad 42 against the material to be polished 40 with equal pressure, a air pressure cylinder mechanism 30 is attached to the upper end of axle 26, and thus all polishing pads 42 are connected to a common pressurized air source; furthermore, a polishing slurry supply path 31 is provided in a recessed manner in the lower end of axle 26, a jacket 32 enclosing axle 26 is provided in support frame 21, and polishing slurry may be supplied to the front surface of the polishing pads 42 via this jacket 32 and supply path 31.

In FIG. 5, one polishing head comprises four polishing pads, and the case is shown in which one polishing head is employed; however, with respect to the number of polishing heads 6, this is not limited to one as depicted, and 2–3 or more may be employed.

As a result of the above structure, each polishing pad 42 is caused to revolve while rotating as a result of the epicyclic gear mechanism in the polishing head 6, and by means of the transverse motion mechanism 7 and the longitudinal motion mechanism 8, the polishing head 6 is swept in the transverse and longitudinal directions.

On the other hand, holder 43 is caused to rotate. In addition to this rotation, holder 43 is caused to move in the transverse and longitudinal directions so as to be perpendicular to the movement in the transverse and longitudinal directions of polishing head 6.

As a result of the motion of polishing head 6 and the holder, the polishing slurry is supplied to the center of the front surface of polishing pads 42 (that is to say, the interface between polishing pad 42 and the material to be polished 40). By means of this, the polishing slurry is supplied in a uniform manner to the interface between the surface of the material to be polished and the surface of the polishing pads, and the microgranules in the polishing slurry are caused to move in a uniform manner in all directions in the vicinity of these surfaces as a result of the relative motion of the surface of the material to be polished and the surface of the polishing pads. As a result, it is possible to achieve the desired degree of flatness.

Furthermore, FIG. 1 shows an expanded view of the periphery of a material to be polished. A dummy plate 41 which surrounds the periphery of the material to be polished 40 is provided so as to be essentially in the same plane with the polishing surface of the material to be polished 40. Even if a portion of the polishing pad 42 extends to the outside of the material to polished 40, this portion will be present on the dummy plate 41, so that the polishing pad 42 will not incline, and there will be no excessive polishing of the periphery of the material to be polished 40.

In the present example, a gap of 1–3 mm is provided between the material to be polished and the dummy plate 41. Furthermore, radial grooves 44 are provided in the rear face of the dummy plate 41. Reference 45 indicates a path for exhausting the polishing slurry to the exterior of the apparatus.

In the apparatus of the present invention, the polishing pads are smaller than the polishing head. Accordingly, it is possible to monitor the polishing state. It is possible to direct lasers onto the surface, and to measure in real time the state of the surface or the remaining film thickness by means of the reflected light.

The slurry supply rate was set at 100 ml/min, the pad application pressure was set to 100 mg/cm$^2$, the pad rotational speed was set at 1000 rpm, the pad speed of revolution was set to 200 rpm, the wafer rotational speed was set to 100 rpm, and the speed of movement of the wafer in the horizontal direction was set to 1.5 m/min, and polishing was conducted using the apparatus shown in FIG. 5.

In contrast to the case in which the supply of the slurry was conducted solely by means of its own weight, in which a polishing speed of approximately 40 nm/min was attained, when pressurized supply was conducted using a volumetric pump, a polishing speed of 150 nm/min was achieved. This is due to the fact that when the slurry is supplied by dripping, it is impossible to uniformly supply the slurry to the surface of the pad, and effective polishing only takes place in limited areas.

Furthermore, when the slurry was not degassed under identical conditions, this resulted in localized regions in which the polishing speed was slowed by approximately 10%. In contrast, by means of conducting degassing of the slurry, and reducing the dissolved gas component to a level of ppb, it was possible to obtain a uniform polished state over the entirety of the wafer surface.

In accordance with the invention as described above, it is possible to rub polishing pads in a symmetrical and minute manner against the surface of a material to be polished, and accordingly, it is possible to execute highly precise polishing with high efficiency even in the case of semiconductor devices which are ultraminute and have large differences in level.

What is claimed is:

1. A chemical to mechanical polishing apparatus comprising:

a polishing plate holder;

means for adhering said polishing plate holder to a material to be polished;

said polishing plate holder being rotatable about an axle;

at least one polishing pad, said polishing pad having a diameter smaller than the diameter of material to be polished, and each said at least one polishing pad disposed about said axle, said at least one polishing pad having a front surface and a rear surface;

a means for causing said at least one polishing pad to rotate;

a means for causing said at least one polishing pad to revolve about said axle;

a means for moving said at least one polishing pad in a transverse and longitudinal direction with respect to the material to be polished, said polishing pad front surface being rubbable against the surface of the material to be polished whereby material larger than said at least one polishing pad are polished; and a polished slurry supplied to the center of said polishing pad front surface.

2. A chemical mechanical polishing apparatus in accordance with claim 1 further comprising:

a dummy plate surrounding the periphery of the material to be polished and provided so as to be essentially in the same plane with the surface of the material to be polished.

3. A chemical mechanical polishing apparatus in accordance with claim 2 further comprising a nozzle for spraying washing water onto the material to be polished, and a means for applying ultrasound to the washing water.

4. A chemical mechanical polishing apparatus in accordance with claim 2 in which a gap of approximately 1 to 3 mm is provided between said dummy plate and the periphery of the material to be polished.

5. A chemical mechanical polishing apparatus in accordance with claim 4 in which said dummy plate has radial grooves formed on said rear surface thereof.

6. A chemical mechanical polishing apparatus in accordance with claim 4 in which said holder has radial grooves formed therein and said holder in contact with the rear surface of said dummy plate.

7. A chemical mechanical polishing apparatus in accordance with claim 2 in which said dummy plate comprises alumina.

8. A chemical mechanical polishing apparatus in accordance with claim 7 further comprising a means for removing gas present in the polishing slurry.

9. A chemical mechanical polishing apparatus in accordance with claim 1 further comprising air cylinders for pressing the polishing pads against the material to be polished, and a means for controlling the pressure of said air cylinders.

10. A chemical mechanical polishing apparatus in accordance with claim 1 further comprising a means for supplying the polishing slurry under pressure.

* * * * *